US012668949B2

(12) United States Patent
Kyozu et al.

(10) Patent No.: US 12,668,949 B2
(45) Date of Patent: Jun. 30, 2026

(54) WORK MACHINE, METHOD AND SYSTEM FOR CONTROLLING WORK MACHINE

(71) Applicant: KOMATSU LTD., Tokyo (JP)

(72) Inventors: Akihiro Kyozu, Tokyo (JP); Takeshi Kamimae, Tokyo (JP)

(73) Assignee: KOMATSU LTD., Tokyo (JP)

( * ) Notice: Subject to any disclaimer, the term of this patent is extended or adjusted under 35 U.S.C. 154(b) by 208 days.

(21) Appl. No.: 18/698,882

(22) PCT Filed: Nov. 10, 2022

(86) PCT No.: PCT/JP2022/041842

§ 371 (c)(1),
(2) Date: Oct. 4, 2024

(87) PCT Pub. No.: WO2023/135917

PCT Pub. Date: Jul. 20, 2023

(65) Prior Publication Data

US 2025/0305247 A1 Oct. 2, 2025

(30) Foreign Application Priority Data

Jan. 13, 2022 (JP) ..... 2022-003646

(51) Int. Cl.
*E02F 9/24* (2006.01)
*E02F 3/76* (2006.01)
*E02F 9/26* (2006.01)

(52) U.S. Cl.
CPC ..... *E02F 9/24* (2013.01); *E02F 3/76* (2013.01); *E02F 9/264* (2013.01)

(58) Field of Classification Search
CPC ..... E02F 9/24; E02F 3/76; E02F 9/264
(Continued)

(56) References Cited

U.S. PATENT DOCUMENTS

2013/0255977 A1* 10/2013 Braunstein ..... E02F 3/764 701/41
2017/0114523 A1* 4/2017 Horstman ..... E02F 9/2087
(Continued)

FOREIGN PATENT DOCUMENTS

JP 2020-160914 A 10/2020
JP 2021-28266 A 2/2021
(Continued)

OTHER PUBLICATIONS

The International Search Report for the corresponding international application No. PCT/JP2022/041842, issued on Jan. 31, 2023.

*Primary Examiner* — Yazan A Soofi
(74) *Attorney, Agent, or Firm* — Spencer Fane LLP

(57) ABSTRACT

A work machine includes a vehicle body, a support member, a blade, a rotation angle sensor, an object sensor, and a controller. The support member is connected to the vehicle body. The blade is rotatably supported by the support member. The rotation angle sensor detects a rotation angle of the blade. The object sensor detects an object around the work machine and outputs a signal indicating a presence or absence of the object. The controller is configured to set a detection range around the work machine. The controller is configured to determine the presence or absence of the object within the detection range based on the signal from the object sensor. The controller is configured to set the detection range according to the rotation angle of the blade.

15 Claims, 13 Drawing Sheets

(58) Field of Classification Search
USPC ..... 701/50
See application file for complete search history.

(56) References Cited

U.S. PATENT DOCUMENTS

| | | | | |
|---|---|---|---|---|
| 2020/0311964 | A1* | 10/2020 | Ishizaki | G06T 7/50 |
| 2021/0350681 | A1* | 11/2021 | Imaizumi | G01S 13/931 |
| 2022/0081877 | A1* | 3/2022 | Schau | E02F 3/764 |
| 2023/0060917 | A1* | 3/2023 | Okamune | E02F 3/815 |

FOREIGN PATENT DOCUMENTS

| | | | |
|---|---|---|---|
| JP | 2021-143579 | A | 9/2021 |
| WO | 2020/066228 | A1 | 4/2020 |

* cited by examiner

WORK MACHINE, METHOD AND SYSTEM FOR CONTROLLING WORK MACHINE

CROSS-REFERENCE TO RELATED APPLICATIONS

This application is a U.S. National stage application of International Application No. PCT/JP2022/041842, filed on Nov. 10, 2022. This U.S. National stage application claims priority under 35 U.S.C. § 119(a) to Japanese Patent Application No. 2022-003646, filed in Japan on Jan. 13, 2022, the entire contents of which are hereby incorporated herein by reference.

BACKGROUND

Technical Field

The present invention relates to a work machine, method and a system for controlling a work machine.

Background Information

Conventionally, in work machines, technology has been used to detect people or obstacles in the vicinity using sensors such as radar. For example, Japanese Patent Application Publication No. 2021-28266 discloses a forklift equipped with an object detection system. The object detection system includes a radar device such as a millimeter wave radar. The radar device detects the presence or absence of an object by emitting radio waves or ultrasonic waves and receiving the radio waves or ultrasonic waves reflected by the object.

In the above object detection system, if a warning is output every time objects that have entered the measurable range of the radar device are detected, the warning will be issued frequently. Therefore, in the object detection system described above, the controller sets a detection range around the forklift, and outputs a warning when an object is detected within the detection range. Furthermore, the detection range is changed depending on the vehicle speed and the steering angle of the forklift.

SUMMARY

In the object detection system described above, it is possible to appropriately determine whether or not an object exists around the forklift by changing the detection range depending on the vehicle speed and the steering angle. However, in a work machine such as a motor grader in which the degree of freedom in the posture of the work implement such as a blade is large, it is not sufficient to apply the above-mentioned technique. An object of the present invention is to appropriately determine whether an object exists around a work machine.

A work machine according to a first aspect of the present invention includes a vehicle body, a support member, a blade, a rotation angle sensor, an object sensor, and a controller. The support member is connected to the vehicle body. The blade is rotatably supported by the support member. The rotation angle sensor detects a rotation angle of the blade. The object sensor detects an object around the work machine and outputs a signal indicating a presence or absence of an object. The controller sets a detection range around the work machine. The controller determines the presence or absence of an object within the detection range based on the signal from the object sensor. The controller sets the detection range according to the rotation angle of the blade.

A method according to a second aspect of the invention is a method for controlling a work machine. The work machine includes a vehicle body, a support member, and a blade. The support member is connected to the vehicle body. The blade is rotatably supported by the support member. The method includes acquiring a rotation angle of the blade, receiving a signal indicating a presence or absence of an object around the work machine, setting a detection range around the work machine, determining the presence or absence of an object within the detection range based on the signal, and setting the detection range according to the rotation angle of the blade.

A system according to a third aspect of the present invention is a system for controlling a work machine. The work machine includes a vehicle body, a support member, and a blade. The support member is connected to the vehicle body. The blade is rotatably supported by the support member. The system includes a rotation angle sensor, an object sensor, and a controller. The rotation angle sensor detects a rotation angle of the blade. The object sensor detects an object around the work machine and outputs a signal indicating a presence or absence of the object. The controller sets a detection range around the work machine. The controller determines the presence or absence of an object within the detection range based on the signal from the object sensor. The controller sets the detection range according to the rotation angle of the blade.

In the present invention, the detection range of objects around the work machine is set according to the rotation angle of the blade. Thereby, it is possible to appropriately determine whether an object exists around the work machine.

DETAILED DESCRIPTION OF EMBODIMENT(S)

Figure 1:
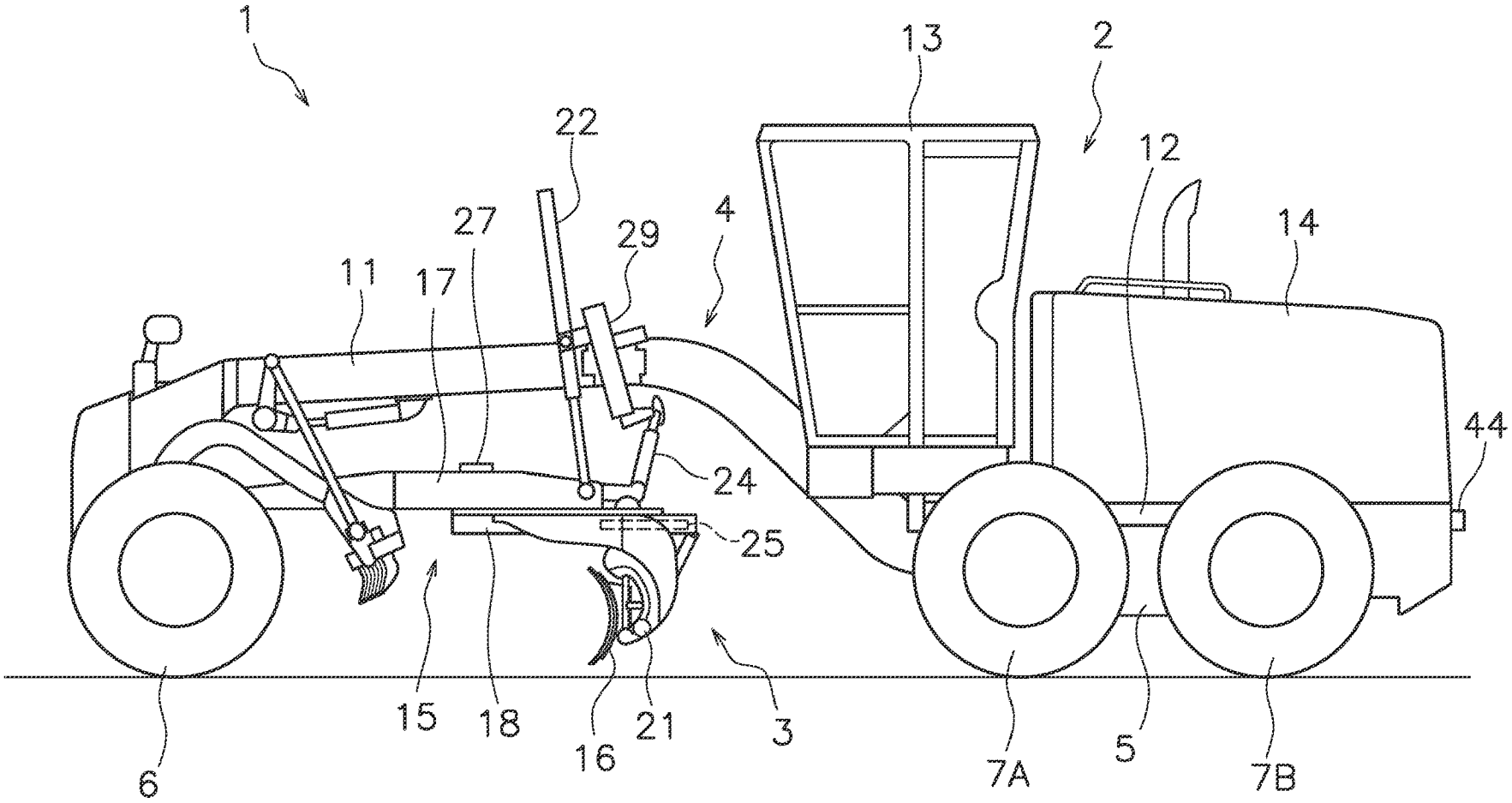
FIG. 1 is a side view of a work machine according to an embodiment.
Figure 2:
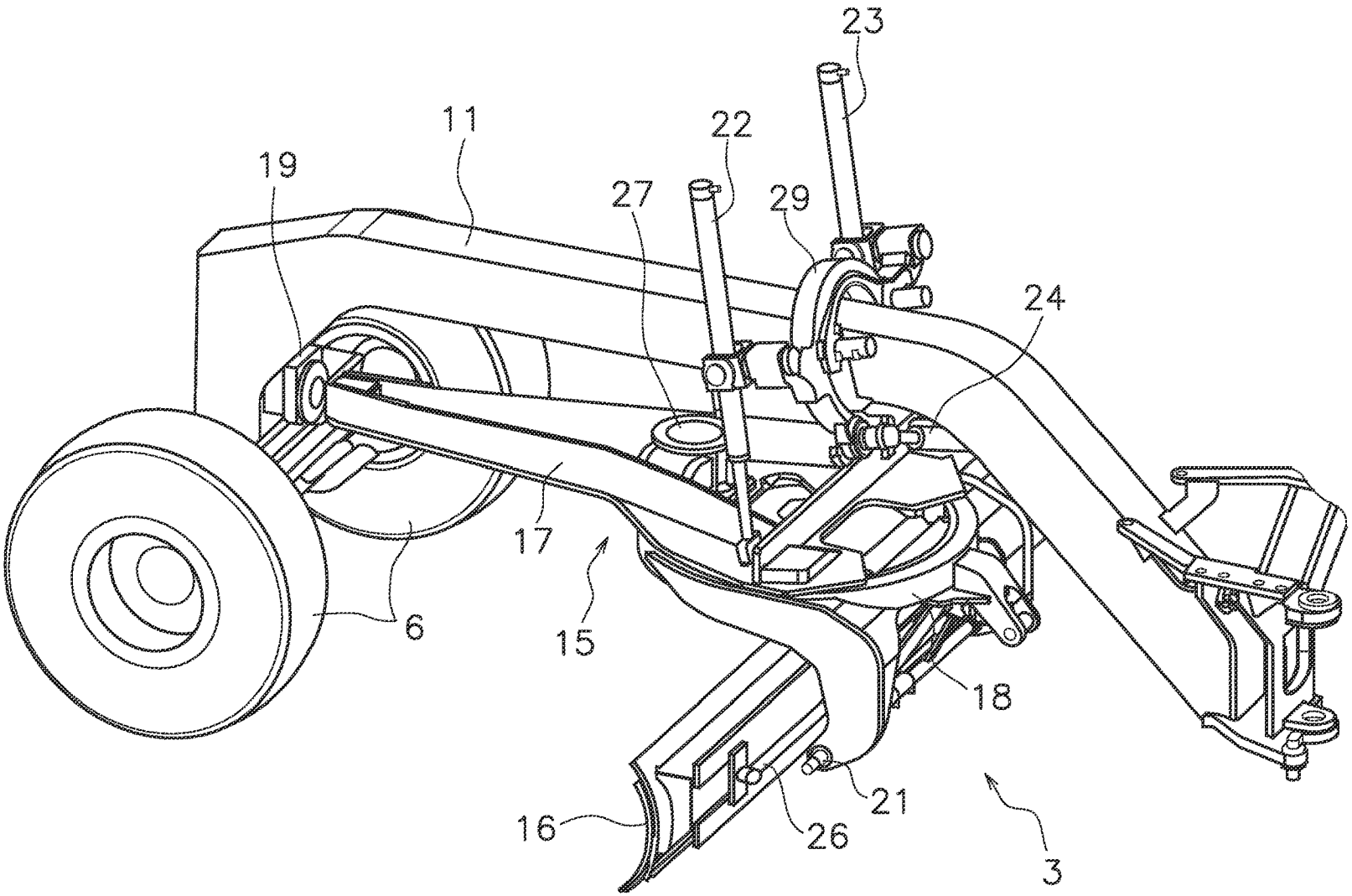
FIG. 2 is a perspective view of a front part of the work machine.

An embodiment of the present invention will be described below with reference to the drawings. FIG. 1 is a side view of a work machine 1 according to an embodiment. FIG. 2 is a perspective view of the front part of the work machine 1. The work machine 1 according to the present embodiment is a motor grader. As shown in FIG. 1, the work machine 1 includes a vehicle body 2 and a work implement 3. The work implement 3 is movably supported by the vehicle body 2. The vehicle body 2 includes a vehicle body frame 4, a tandem drive 5, front wheels 6, and rear wheels 7A and 7B.

The vehicle body frame 4 supports the front wheels 6 and the work implement 3. The vehicle body frame 4 includes a front frame 11 and a rear frame 12. The rear frame 12 is connected to the front frame 11. The front frame 11 is configured to be articulated laterally with respect to the rear frame 12. In the following description, the front, rear, left, and right directions mean the front, rear, left, and right directions of the vehicle body 2 when the articulation angle is 0, that is, the front frame 11 and the rear frame 12 are straight.

A cab 13 and a power chamber 14 are disposed on the rear frame 12. A driver's seat (not shown) is disposed in the cab 13. A drive system, which will be described later, is disposed in the power chamber 14. The front frame 11 extends forward from the rear frame 12. The front wheels 6 are attached to the front frame 11. The tandem drive 5 is connected to the rear frame 12. The tandem drive 5 supports the rear wheels 7A and 7B and drives the rear wheels 7A and 7B. Note that in FIG. 1, only the left rear wheels 7A and 7B are shown.

The work implement 3 is movably connected to the vehicle body 2. The work implement 3 includes a support member 15 and a blade 16. The support member 15 is movably connected to the vehicle body 2. The support member 15 supports the blade 16. The support member 15 includes a drawbar 17 and a circle 18. The drawbar 17 and the circle 18 are disposed below the front frame 11.

As shown in FIG. 2, the drawbar 17 is connected to a pivot support 19 of the front frame 11. The pivot support 19 is disposed at the front part of the front frame 11. The draw bar 17 extends rearward from the front part of the front frame 11. The draw bar 17 is supported by the front frame 11 so as to be swingable at least in the vertical and horizontal directions of the vehicle body 2. For example, the pivot support 19 includes a ball joint. The draw bar 17 is rotatably connected to the front frame 11 via the ball joint.

The circle 18 is connected to the rear part of the drawbar 17. The circle 18 is rotatably supported by the drawbar 17. The blade 16 is connected to the circle 18. The blade 16 is supported by the drawbar 17 via the circle 18. The blade 16 is rotatably supported by the circle 18 around a tilt axis 21. The tilt axis 21 extends in the left-right direction. The blade 16 is supported by the circle 18 so as to be slidable in the left-right direction.

The work machine 1 includes a plurality of actuators 22 to 27 for changing the attitude of the work implement 3. The plurality of actuators 22 to 27 include a plurality of hydraulic cylinders 22 to 26. The plurality of hydraulic cylinders 22 to 26 are connected to the work implement 3. The plurality of hydraulic cylinders 22 to 26 expand and contract using hydraulic pressure. The plurality of hydraulic cylinders 22 to 26 change the attitude of the work implement 3 with respect to the vehicle body 2 by expanding and contracting. In the following explanation, the expansion and contraction of the hydraulic cylinder will be referred to as a "stroke operation."

Specifically, the plurality of hydraulic cylinders 22 to 26 include a left lift cylinder 22, a right lift cylinder 23, a drawbar shift cylinder 24, a blade tilt cylinder 25, and a blade shift cylinder 26. The left lift cylinder 22 and the right lift cylinder 23 are disposed apart from each other in the left-right direction. The left lift cylinder 22 is connected to the left portion of the drawbar 17. The right lift cylinder 23 is connected to the right portion of the drawbar 17. The left lift cylinder 22 and the right lift cylinder 23 are connected to the draw bar 17 so as to be swingable left and right.

The left lift cylinder 22 and the right lift cylinder 23 are connected to the front frame 11 so as to be swingable left and right. Specifically, the left lift cylinder 22 and the right lift cylinder 23 are connected to the front frame 11 via a lifter bracket 29. The lifter bracket 29 is connected to the front frame 11. The lifter bracket 29 supports the left lift cylinder 22 and the right lift cylinder 23 so as to be swingable left and right. Due to the stroke motion of the left lift cylinder 22 and the right lift cylinder 23, the draw bar 17 swings up and down around the pivot support 19. This causes the blade 16 to move up and down.

The drawbar shift cylinder 24 is connected to the drawbar 17 and the front frame 11. The drawbar shift cylinder 24 is connected to the front frame 11 via the lifter bracket 29. The draw bar shift cylinder 24 is swingably connected to the front frame 11. The drawbar shift cylinder 24 is swingably connected to the drawbar 17. The drawbar shift cylinder 24 extends diagonally downward from the front frame 11 toward the drawbar 17. The draw bar shift cylinder 24 extends from one side of the front frame 11 in the left-right direction toward the opposite side. By the stroke operation of the drawbar shift cylinder 24, the drawbar 17 swings left and right around the pivot support 19.

As shown in FIG. 1, the blade tilt cylinder 25 is connected to the circle 18 and the blade 16. The stroke operation of the blade tilt cylinder 25 causes the blade 16 to rotate around the tilt axis 21. As shown in FIG. 2, the blade shift cylinder 26 is connected to the circle 18 and the blade 16. The stroke operation of the blade shift cylinder 26 causes the blade 16 to slide left and right with respect to the circle 18.

The plurality of actuators 22 to 27 include a rotary actuator 27. The rotary actuator 27 is connected to the draw bar 17 and the circle 18. The rotary actuator 27 rotates circle 18 relative to the draw bar 17. Thereby, the blade 16 rotates around the rotation axis extending in the vertical direction.

Figure 3:
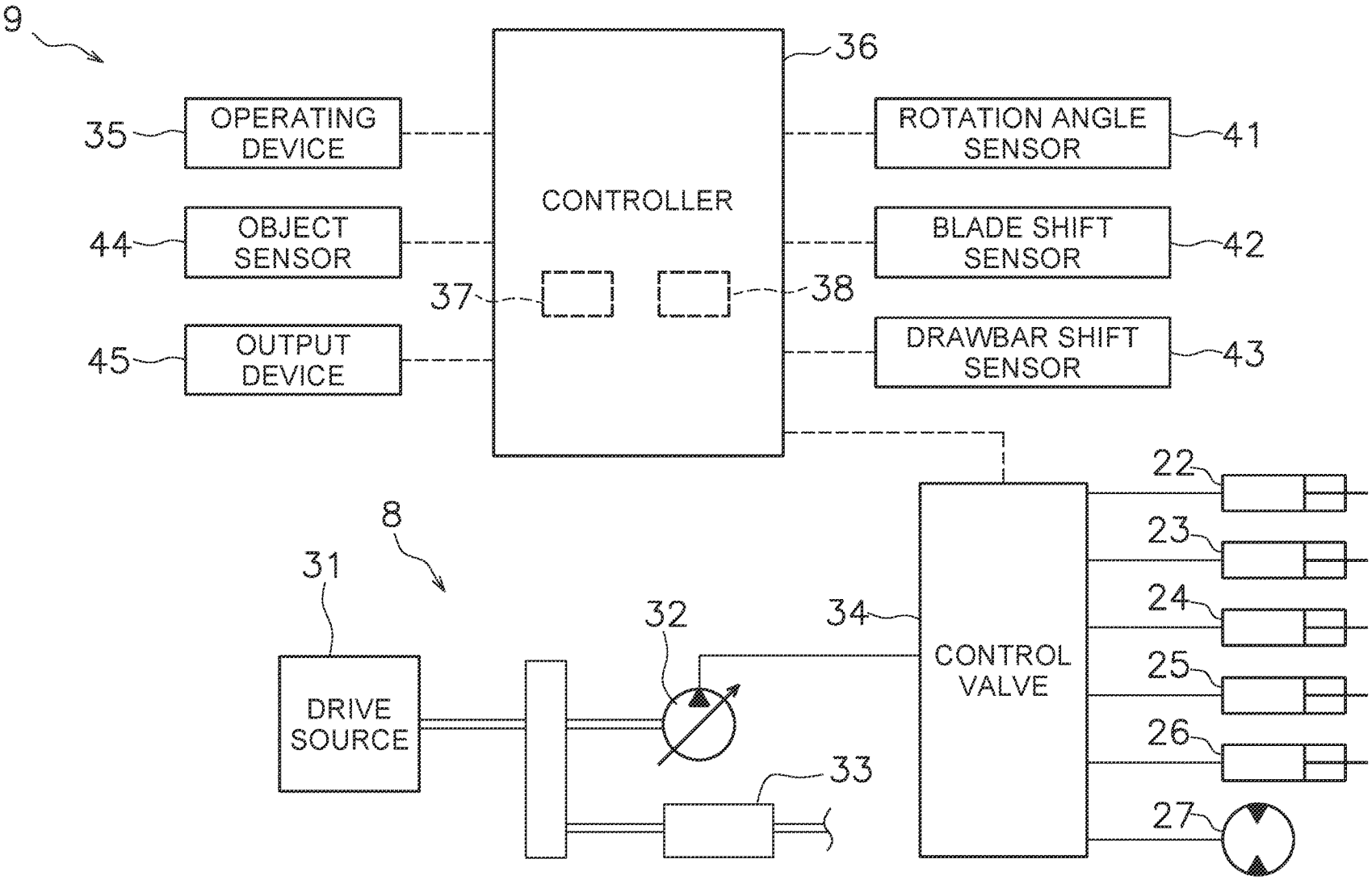
FIG. 3 is a schematic diagram showing a drive system and a control system of the work machine.

FIG. 3 is a schematic diagram showing a drive system 8 and a control system 9 of the work machine 1. As shown in FIG. 3, the work machine 1 includes a drive source 31, a hydraulic pump 32, a power transmission device 33, and a control valve 34. The drive source 31 is, for example, an internal combustion engine. Alternatively, the drive source 31 may be an electric motor or a hybrid of an internal combustion engine and an electric motor. The hydraulic pump 32 is driven by the drive source 31 to discharge hydraulic fluid.

The control valve 34 is connected to the hydraulic pump 32 and the plurality of hydraulic cylinders 22 to 26 via a hydraulic circuit. The control valve 34 includes a plurality of valves each connected to a plurality of hydraulic cylinders 22 to 26. The control valve 34 controls the flow rate of hydraulic fluid supplied from the hydraulic pump 32 to the plurality of hydraulic cylinders 22 to 26.

The rotary actuator 27 is a hydraulic motor. The control valve 34 is connected to the hydraulic pump 32 and the rotary actuator 27 via a hydraulic circuit. The control valve 34 controls the flow rate of hydraulic fluid supplied from the hydraulic pump 32 to the rotary actuator 27. Note that the rotary actuator 27 may be an electric motor.

The power transmission device 33 transmits the driving force from the drive source 31 to the rear wheels 7A and 7B. The power transmission device 33 may include a torque converter and/or a plurality of speed change gears. Alternatively, the power transmission device 33 may be a transmission such as an HST (Hydraulic Static Transmission) or an HMT (Hydraulic Mechanical Transmission).

As shown in FIG. 3, the work machine 1 includes an operating device 35 and a controller 36. The operating device 35 is operable by an operator to change the attitude of the work implement 3. The attitude of the work implement 3 indicates the position and orientation of the blade 16 with respect to the vehicle body 2. The operating device 35 includes, for example, a plurality of levers. In accordance with the operation of the operating device 35, the stroke operations of the plurality of hydraulic cylinders 22 to 26 and the rotation operation of the rotary actuator 27 are controlled. Thereby, the attitude of the work implement 3 is changed.

The controller 36 controls the drive source 31 and the power transmission device 33 to cause the work machine 1 to travel. Further, the controller 36 controls the hydraulic pump 32 and the control valve 34 to operate the work implement 3. The controller 36 includes a processor 37 and a storage device 38. The processor 37 is, for example, a CPU, and executes a program for controlling the work machine 1. The storage device 38 includes memories such as RAM and ROM, and auxiliary storage devices such as SSD or HDD. The storage device 38 stores programs and data for controlling the work machine 1.

Figure 4:
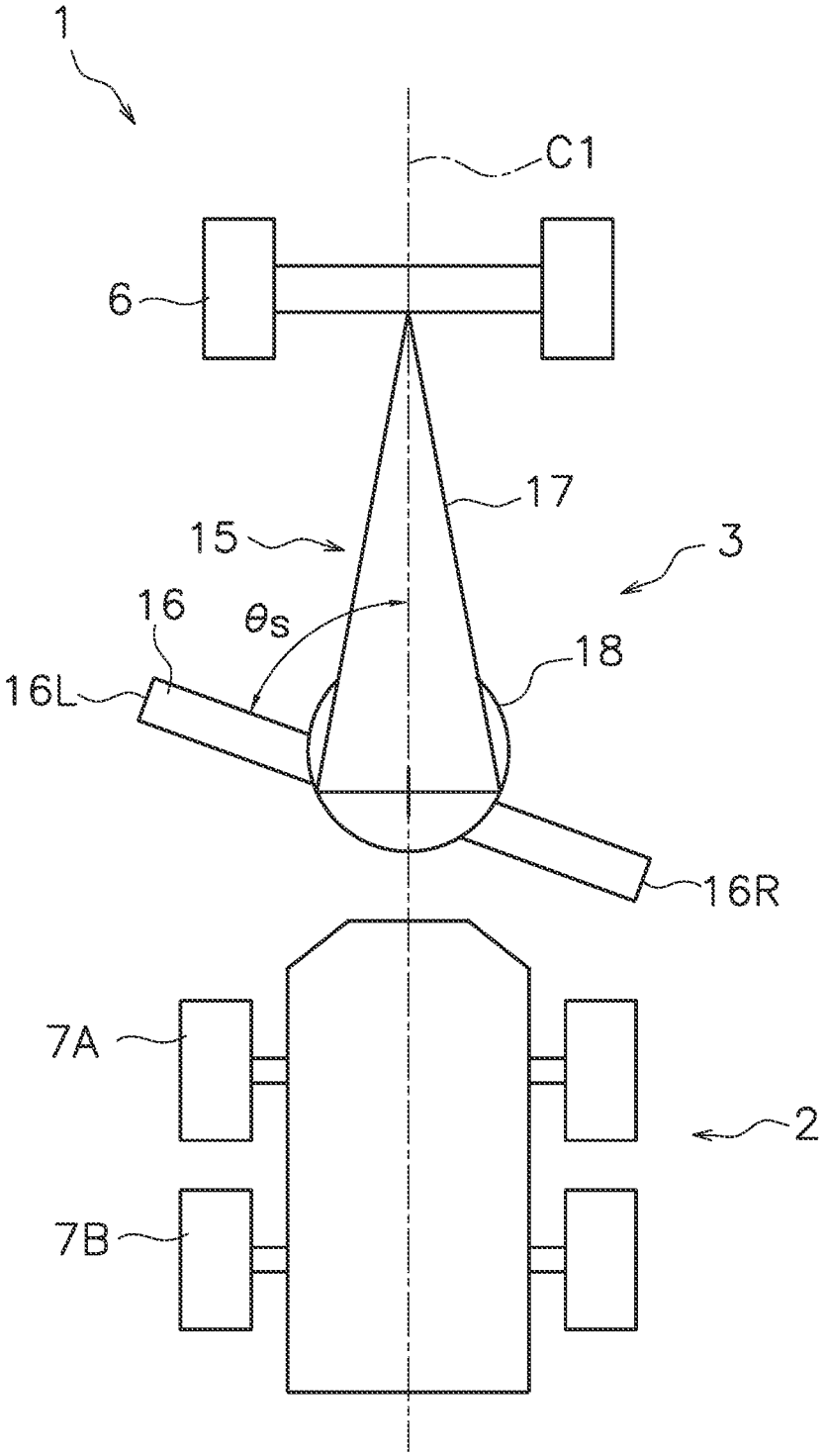
FIG. 4 is a schematic plan view of the work machine showing an attitude of a work implement.

As shown in FIG. 3, the work machine 1 includes a rotation angle sensor 41, a blade shift sensor 42, and a draw bar shift sensor 43. The rotation angle sensor 41 detects the rotation angle θs of the blade (hereinafter referred to as "blade rotation angle"). As shown in FIG. 4, the blade rotation angle θs is the angle of the blade 16 with respect to the center line C1 of the vehicle body 2 extending in the longitudinal direction of the work machine 1. In the following description, it is assumed that the articulation angle is 0 degrees, that is, the front frame 11 and the rear frame 12 are in a straight state. The rotation angle sensor 41 is, for example, an IMU or a camera. The rotation angle sensor 41 outputs a signal indicating the blade rotation angle θs.

Figure 5:
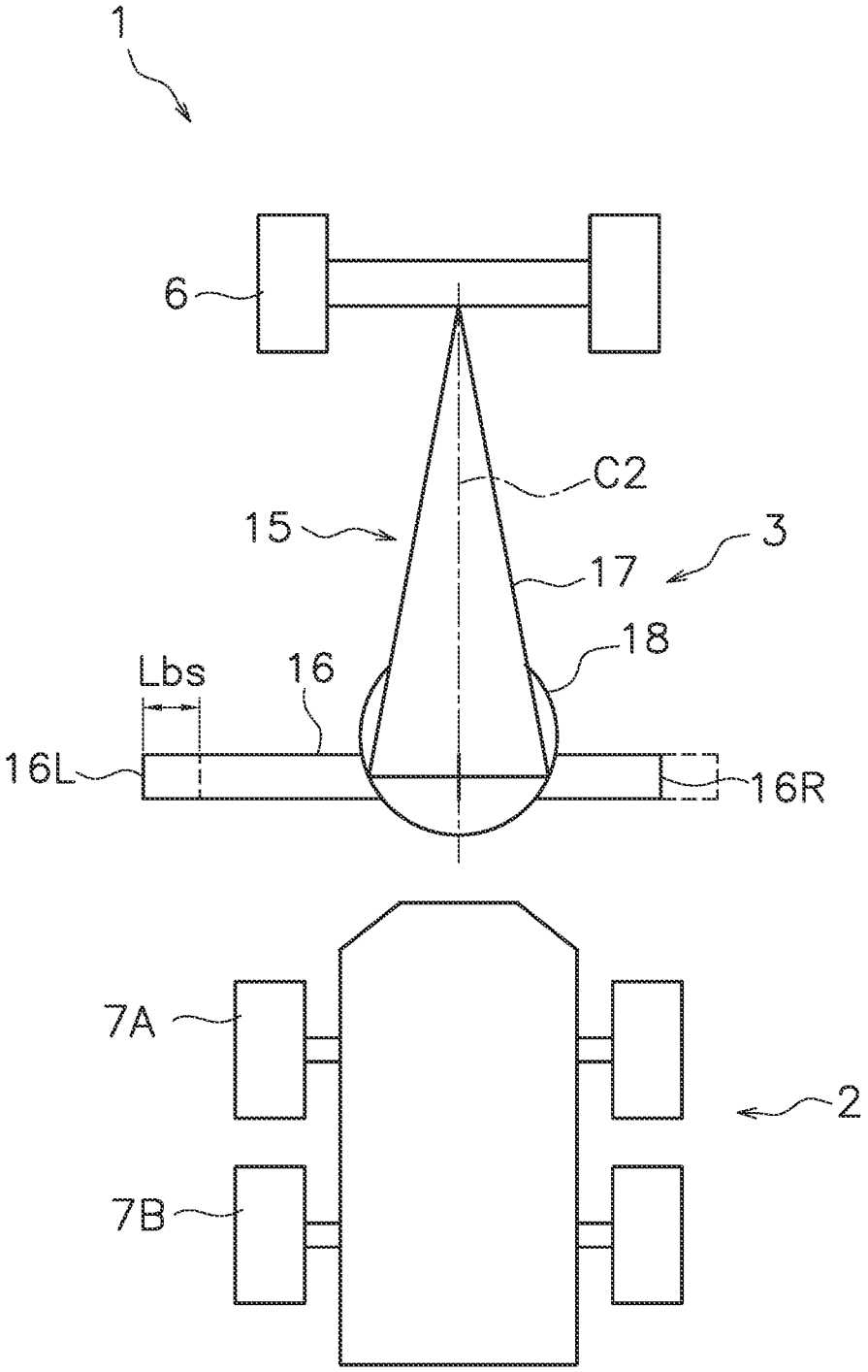
FIG. 5 is a schematic plan view of the work machine showing the attitude of the work implement.

The blade shift sensor 42 detects the blade shift amount Lbs. As shown in FIG. 5, the blade shift amount Lbs indicates the amount of left and right movement of the blade 16 from the neutral position. When the blade 16 is located at the neutral position, the distances from the center line C2 extending in the longitudinal direction of the draw bar 17 to the left end 16L and right end 16R of the blade 16 are equal. The blade shift sensor 42 outputs a signal indicating the blade shift amount Lbs.

Figure 6:
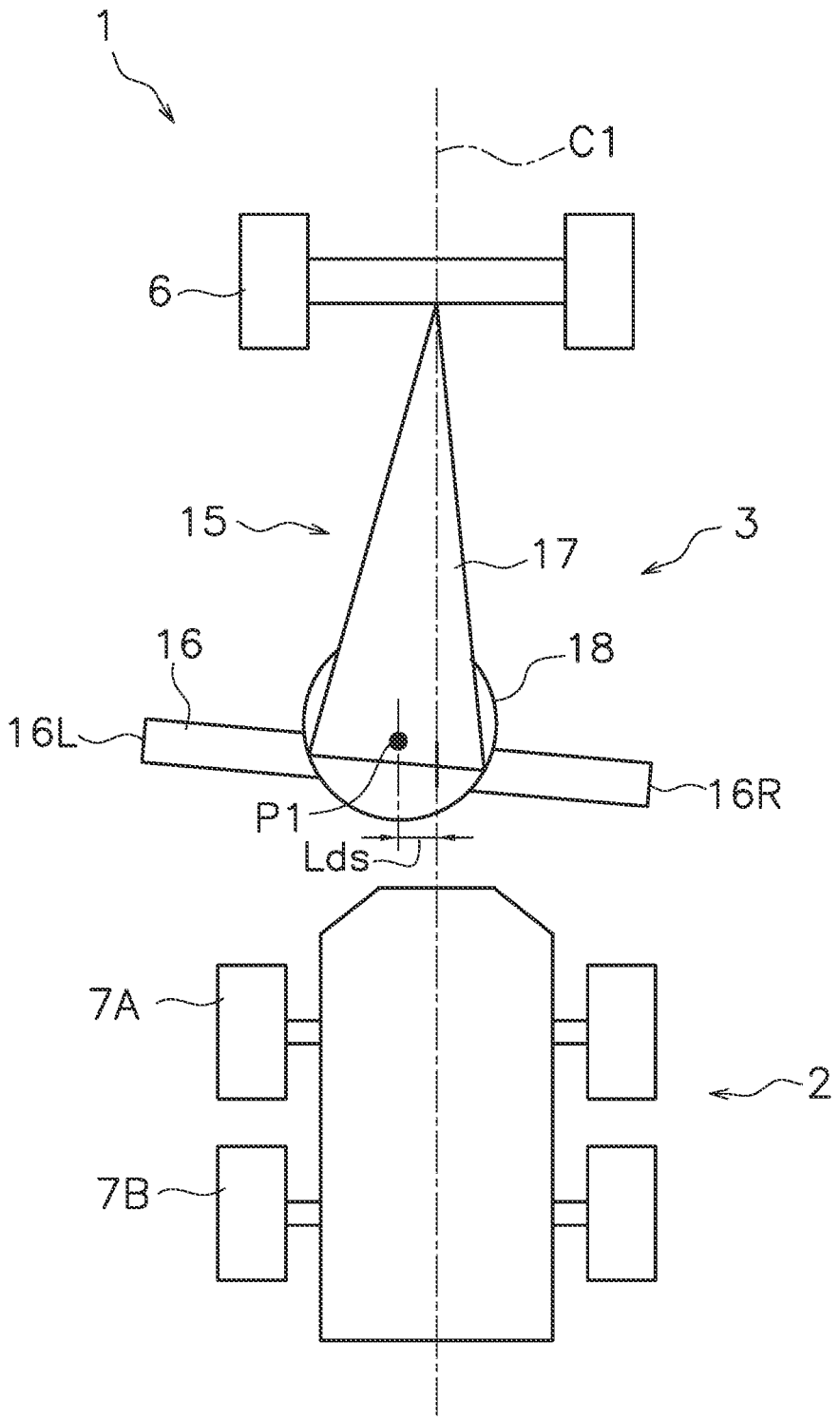
FIG. 6 is a schematic plan view of the work machine showing the attitude of the work implement.

The draw bar shift sensor 43 detects the draw bar shift amount Lds. As shown in FIG. 6, the draw bar shift amount Lds indicates the amount of movement of the draw bar 17 in the left and right directions. For example, the drawbar shift amount Lds is the distance between the center point P1 of the draw bar 17 and the center line C1 of the vehicle body 2. The center point P1 of the draw bar 17 is a point where the above-described center line C2 of the draw bar 17 and the cutting edge of the blade 16 intersect in a plan view of the work machine 1. The draw bar shift sensor 43 outputs a signal indicating the draw bar shift amount Lds. For example, the controller 36 may calculate the position of the cutting edge of the blade 16 from the stroke length of the blade tilt cylinder 25. Alternatively, the position of the cutting edge of the blade 16 may be detected by the IMU. The center point Pl of the draw bar 17 may be the center of the circle 18.

The rotation angle sensor 41, the blade shift sensor 42, and the draw bar shift sensor 43 are, for example, IMUs (inertial measurement units). Alternatively, the rotation angle sensor 41, the blade shift sensor 42, and the draw bar shift sensor 43 may be cameras. In that case, the controller 36 analyzes the images acquired by the rotation angle sensor 41, the blade shift sensor 42, and the draw bar shift sensor 43 to calculate the blade rotation angle θs, the blade shift amount Lbs, and the draw bar shift amount Lds. Alternatively, the blade shift sensor 42 may be a sensor that detects the stroke length of the blade shift cylinder 26. The drawbar shift sensor 43 may be a sensor that detects the stroke length of the draw bar shift cylinder 24.

As shown in FIG. 3, the work machine 1 includes an object sensor 44 and an output device 45. The object sensor 44 detects objects around the work machine 1. The object sensor 44 is, for example, a radar device such as a millimeter wave radar. Alternatively, the object sensor 44 may be another type of sensor such as an ultrasonic sensor, a camera, or a LIDAR (Light Detection and Ranging) device. The object sensor 44 outputs a signal indicating the presence or absence of an object around the work machine 1.

The output device 45 is, for example, a display. The output device 45 displays an image in response to a command signal from the controller 36. Alternatively, the output device 45 may be a speaker. The output device 45 may output audio in response to a command signal from the controller 36.

Figure 8:
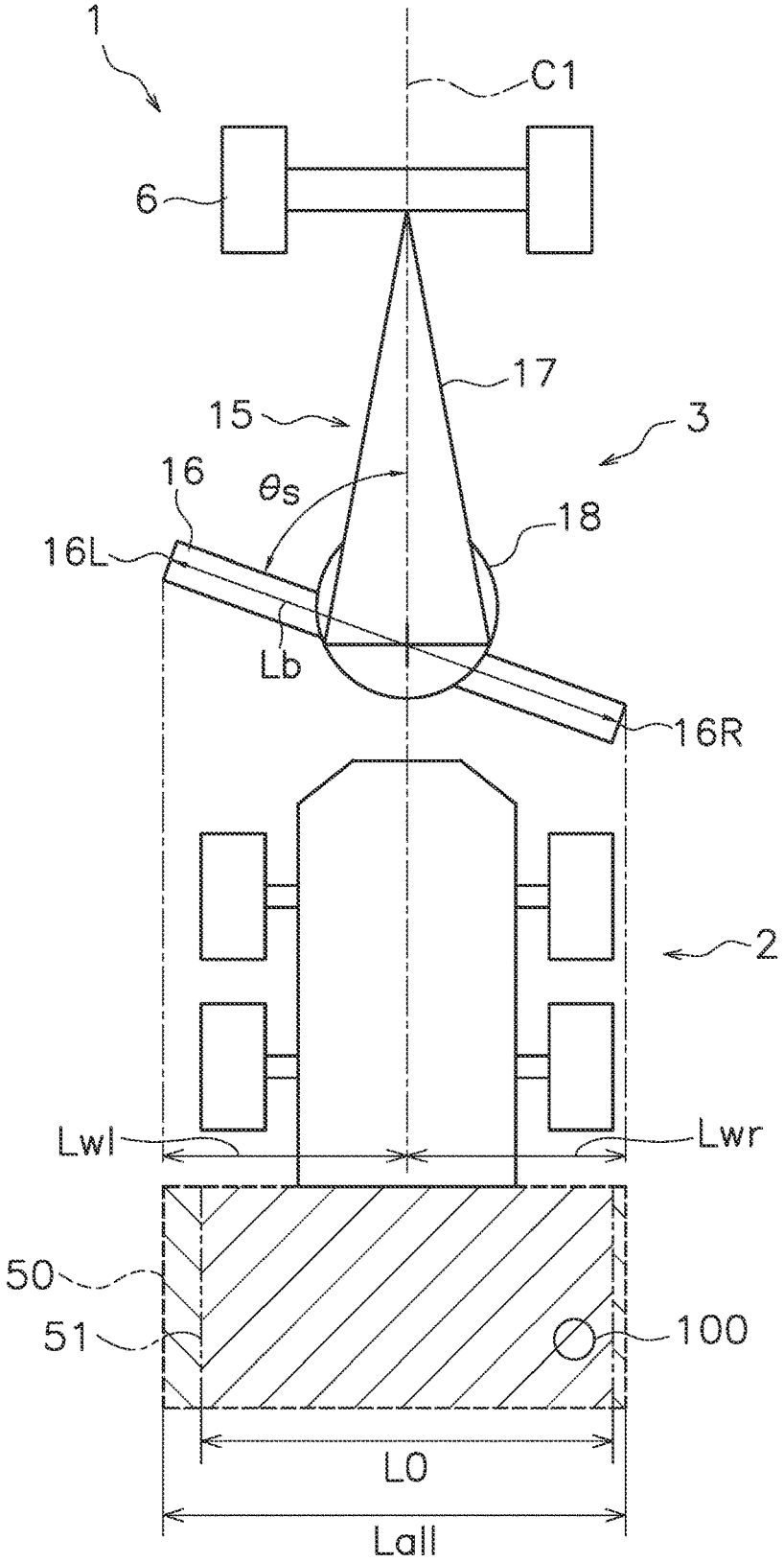
FIG. 8 is a schematic plan view of the work machine showing an example of a detection range.

The controller 36 sets a detection range 50 around the work machine 1 and determines the presence or absence of an object within the detection range 50 based on the signal from the object sensor 44. For example, as shown in FIG. 8, the controller 36 sets a detection range 50 behind the vehicle body 2. However, the controller 36 may set the detection range 50 in front of the vehicle body 2. Alternatively, the controller 36 may set the detection ranges 50 at the front and rear of the vehicle body 2, respectively. When the controller 36 detects the object 100 within the detection range 50, the controller 36 causes the output device 45 to output an alarm.

Figure 7:
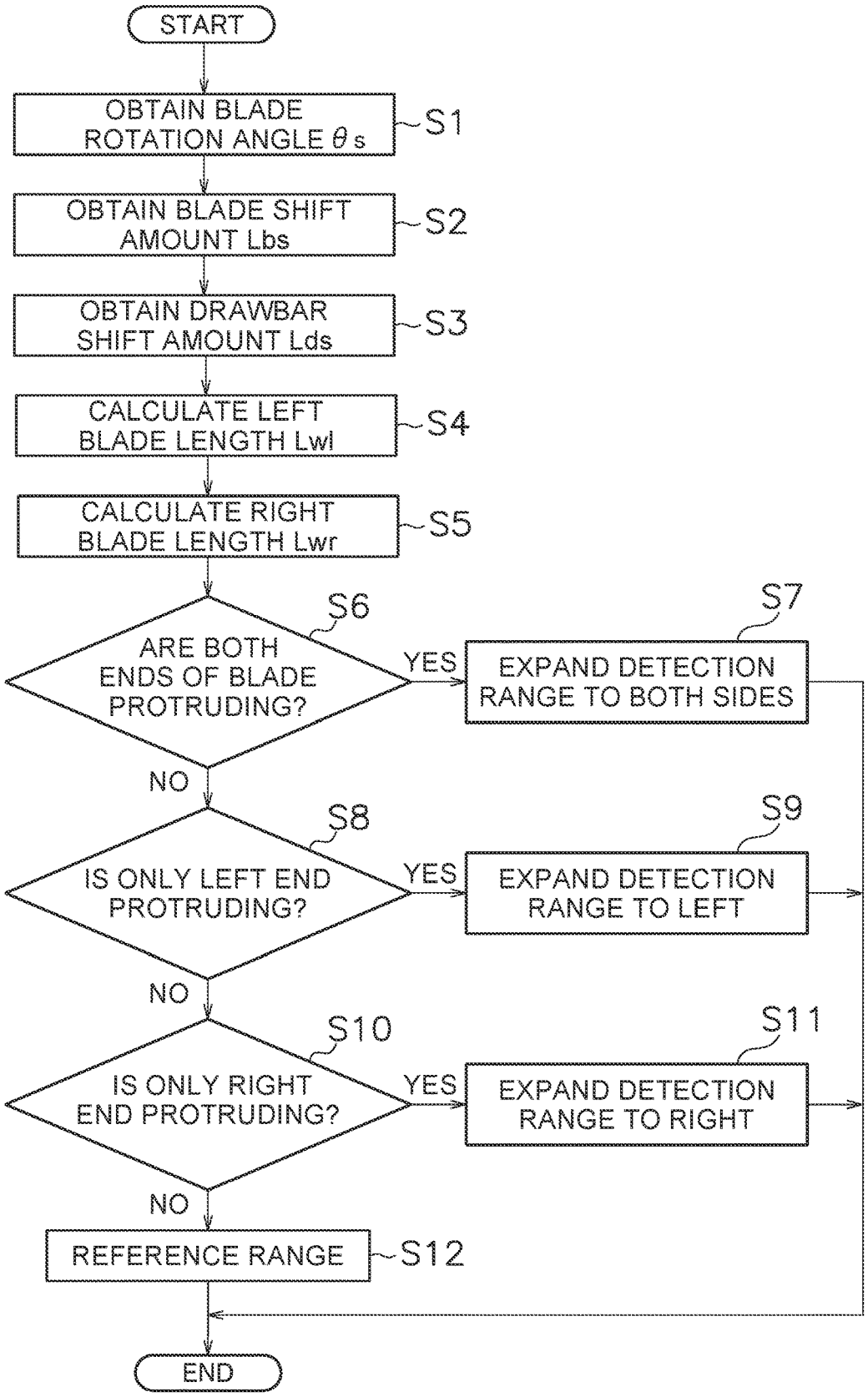
FIG. 7 is a flowchart showing a process for detecting objects around the work machine.

The controller 36 sets the detection range 50 according to the blade rotation angle θs, the blade shift amount Lbs, and the drawbar shift amount Lds. Hereinafter, a method of setting the detection range 50 by the controller 36 will be explained. FIG. 7 is a flowchart illustrating a process executed by the controller 36 for setting the detection range 50.

As shown in FIG. 7, in step S1, the controller 36 obtains the blade rotation angle θs. The controller 36 obtains the blade rotation angle θs based on the signal from the rotation angle sensor 41. In step S2, the controller 36 obtains the blade shift amount Lbs. The controller 36 obtains the blade shift amount Lbs based on the signal from the blade shift sensor 42. In step S3, the controller 36 obtains the drawbar shift amount Lds. The controller 36 obtains the drawbar shift amount Lds based on the signal from the drawbar shift sensor 43.

In step S4, the controller 36 calculates the left blade length Lwl. As shown in FIG. 8, the left blade length Lwl is the distance from the center line C1 of the vehicle body 2 to the left end 16L of the blade 16. The left blade length Lwl indicates the position of the left end 16L of the blade 16 with respect to the center line C1 of the vehicle body 2. The controller 36 calculates the left blade length Lwl from the length Lb of the blade 16, the blade rotation angle θs, the blade shift amount Lbs, and the draw bar shift amount Lds using the following equation (1).

$$Lwl = (Lb/2 + Lbs)\sin\theta s + Lds \quad (1)$$

In step S5, the controller 36 calculates the right blade length Lwr. As shown in FIG. 8, the right blade length Lwr is the distance from the center line C1 of the vehicle body 2 to the right end 16R of the blade 16. The right blade length Lwr indicates the position of the right end 16R of the blade 16 with respect to the center line C1 of the vehicle body 2. The controller 36 calculates the right blade length Lwr from the length Lb of the blade 16, the blade rotation angle θs, the blade shift amount Lbs, and the drawbar shift amount Lds using the following equation (2).

$$Lwr = (Lb/2 - Lbs)\sin\theta s - Lds \quad (2)$$

In addition, in the above equations (1) and (2), the leftward blade shift amount Lbs and draw bar shift amount Lds are defined as positive values, and the rightward blade shift amount Lbs and draw bar shift amount Lds are defined as negative values.

In step S6, the controller 36 determines whether both the left end 16L and right end 16R of the blade 16 protrude from the width L0 of the vehicle body 2 (hereinafter referred to as "vehicle width"), as shown in FIG. 8. The controller 36 determines that both the left end 16L and right end 16R of the blade 16 protrude from the vehicle width L0 when the following first condition is satisfied.

(First condition) $Lwl > L0/2$ and $Lwr > L0/2$

If the controller 36 determines that both the left end 16L and right end 16R of the blade 16 protrude from the vehicle width L0, the process proceeds to step S7.

In step S7, the controller 36 expands the detection range 50 to both left and right sides. As shown in FIG. 8, the controller 36 stores a reference range 51 of the detection range 50. The reference range 51 is set based on the vehicle width L0. The width of the reference range 51 is the same as the vehicle width L0. The controller 36 expands the detection range 50 from the reference range 51 to the left and right in accordance with the positions of the left end 16L and the right end 16R of the blade 16. In this case, the width Lall of the detection range 50 is expressed by the following equation (3).

$$Lall = Lwl + Lwr \quad (3)$$

In step S6, if at least one of the left end 16L and the right end 16R of the blade 16 does not protrude from the vehicle width L0, the process proceeds to step S8. In step S8, the controller 36 determines whether only the left end 16L of the blade 16 protrudes from the vehicle width L0. That is, the controller 36 determines whether the left end 16L of the blade 16 protrudes from the vehicle width L0 and whether the right end 16R of the blade 16 is located within the vehicle width L0.

The controller 36 determines that only the left end 16L of the blade 16 protrudes from the vehicle width L0 when the following second condition is satisfied.

(Second condition) $Lwl > L0/2$ and $Lwr \leqq L0/2$

Figure 9:
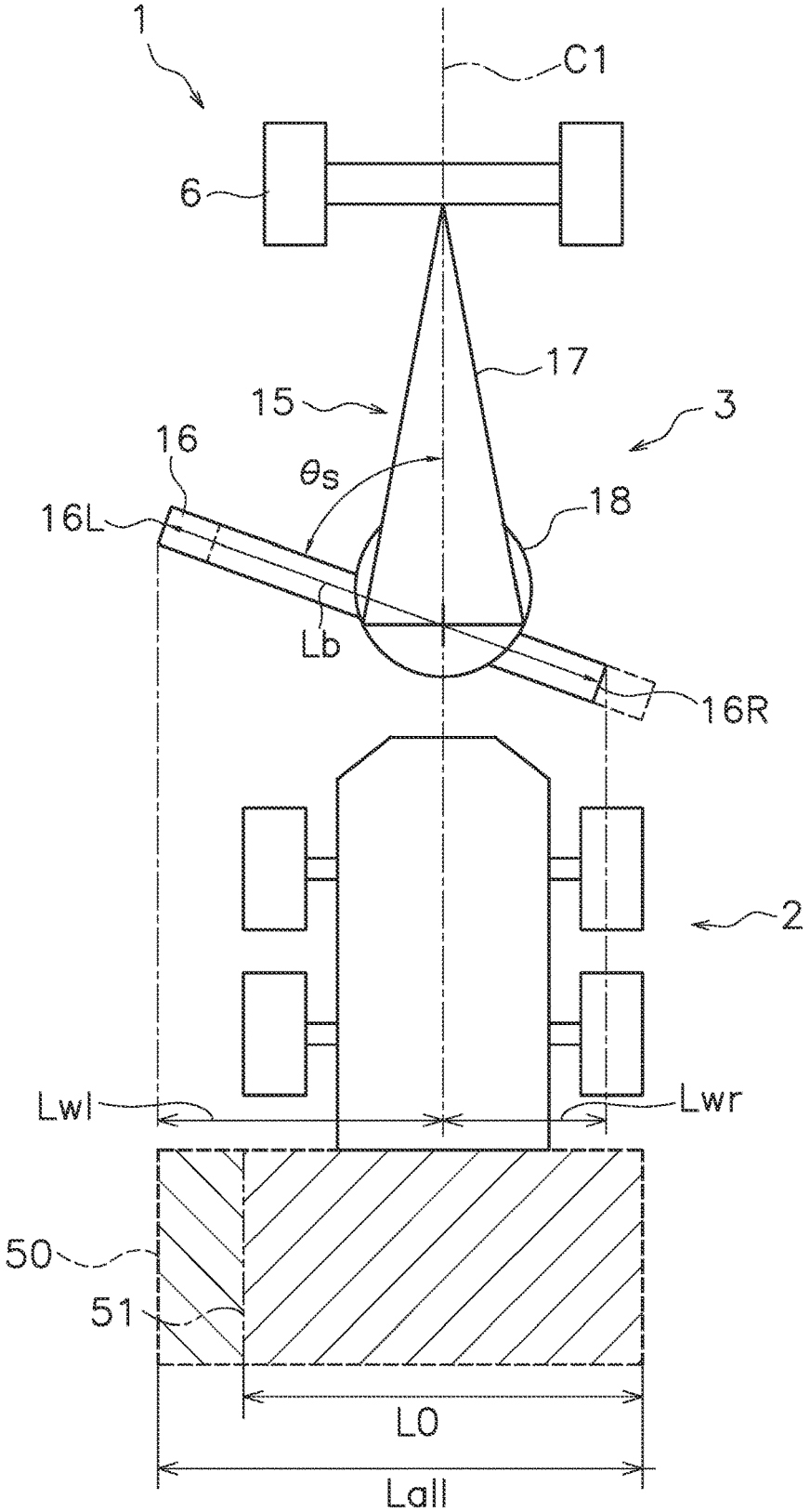
FIG. 9 is a schematic plan view of the work machine showing an example of the detection range.

If the controller 36 determines that only the left end 16L of the blade 16 protrudes from the vehicle width L0, the process advances to step S9. In step S9, the controller 36 expands the detection range 50 to the left. As shown in FIG. 9, the controller 36 expands the detection range 50 to the left from the reference range 51 in accordance with the position of the left end 16L of the blade 16. Furthermore, the controller 36 maintains the detection range 50 within the reference range 51 without expanding it to the right. In this case, the width Lall of the detection range 50 is expressed by the following equation (4).

$$Lall = Lwl + L0/2 \quad (4)$$

Figure 10:
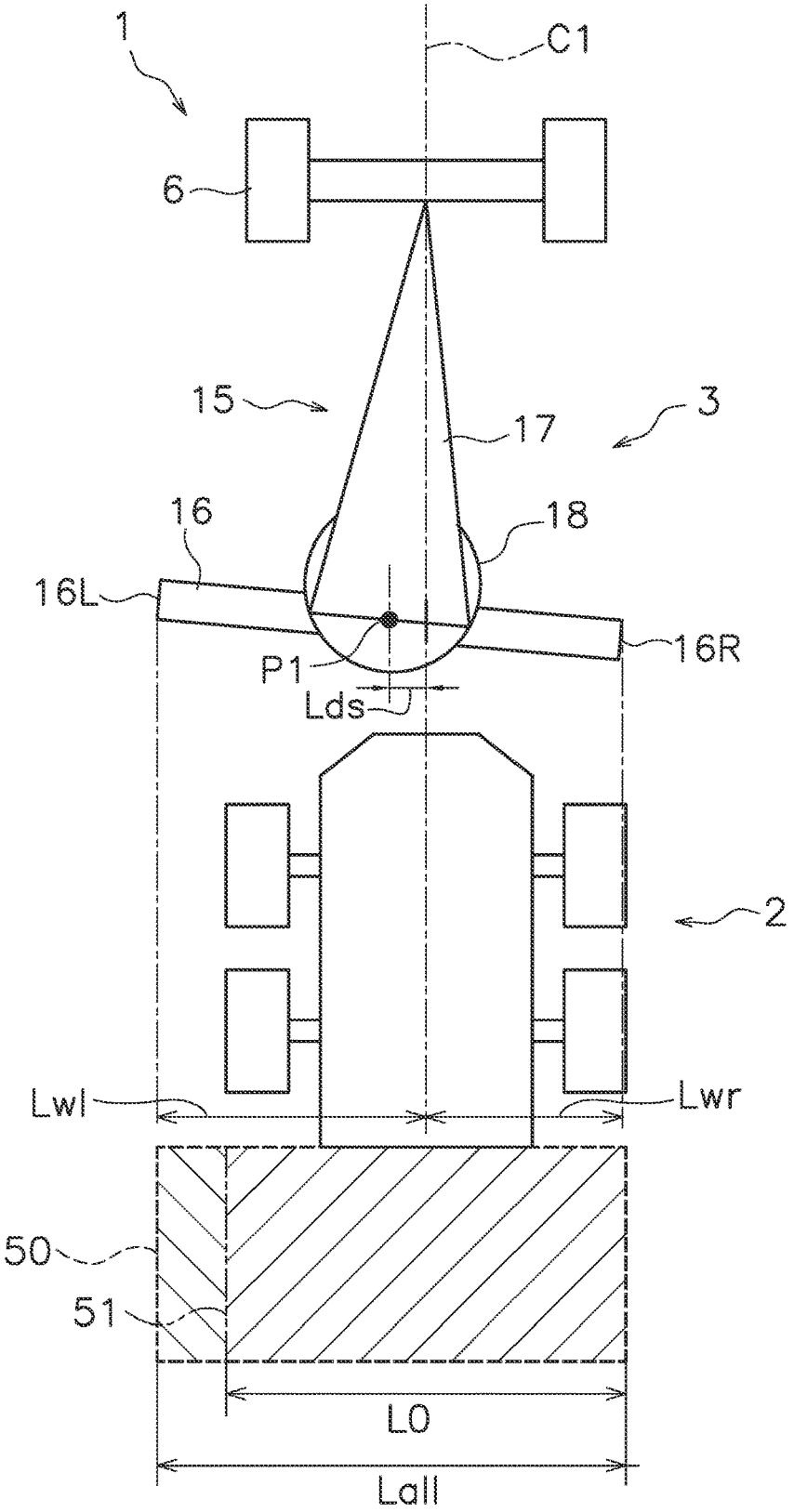
FIG. 10 is a schematic plan view of the work machine showing an example of the detection range.

In FIG. 9, the blade 16 rotates and slides to the left, so that the left end 16L of the blade 16 protrudes from the vehicle width L0. Alternatively, as shown in FIG. 10, when the blade 16 rotates and the drawbar 17 swings to the left so that the left end 16L of the blade 16 protrudes from the vehicle width L0, the controller 36 expands the detection range 50 to the left from the reference range 51.

In step S8, if the left end 16L of the blade 16 does not protrude from the vehicle width L0, the process proceeds to step S10. In step S10, the controller 36 determines whether only the right end 16R of the blade 16 protrudes from the vehicle width L0. That is, the controller 36 determines whether the right end 16R of the blade 16 protrudes from the vehicle width L0 and whether the left end 16L of the blade 16 is located within the vehicle width L0.

The controller 36 determines that only the right end 16R of the blade 16 protrudes from the vehicle width L0 when the following third condition is satisfied.

(Third condition) $Lwr > L0/2$ and $Lwl \leqq L0/2$

Figure 11:
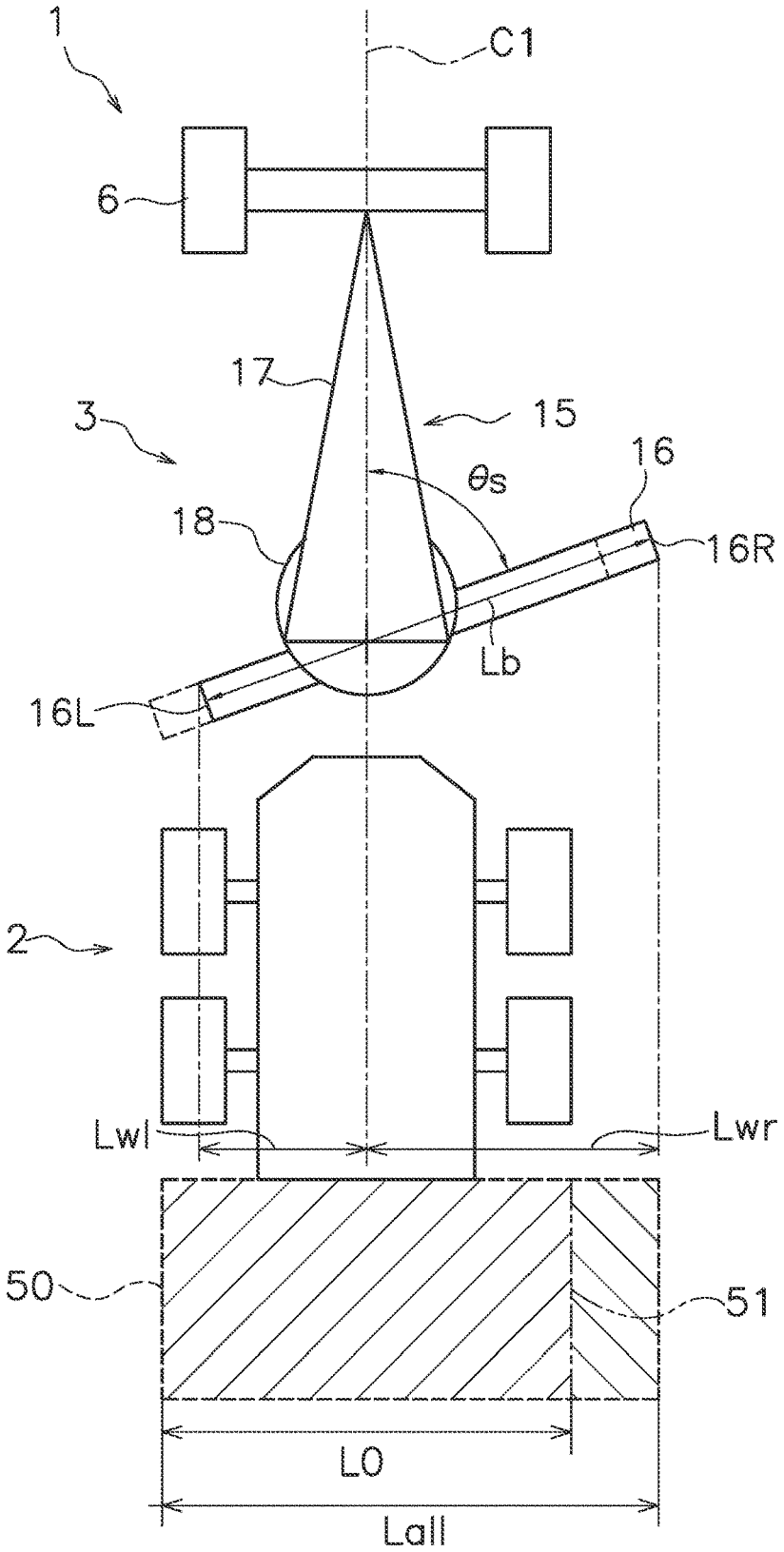
FIG. 11 is a schematic plan view of the work machine showing an example of the detection range.

If the controller 36 determines that only the right end 16R of the blade 16 protrudes from the vehicle width L0, the process proceeds to step S11. In step S11, the controller 36 expands the detection range 50 to the right. As shown in FIG. 11, the controller 36 expands the detection range 50 from the reference range 51 to the right in accordance with the position of the right end 16R of the blade 16. Furthermore, the controller 36 maintains the detection range 50 within the reference range 51 without expanding it to the left. In this case, the width Lall of the detection range 50 is expressed by the following equation (5).

$$Lall = Lwr + L0/2 \quad (5)$$

Although not shown in the drawings, when the blade 16 slides to the right and the drawbar 17 swings to the right so that the position of the right end 16R of the blade 16 protrudes from the vehicle width L0, the controller 36 expands the detection range 50 to the right from the reference range 51.

Figure 12:
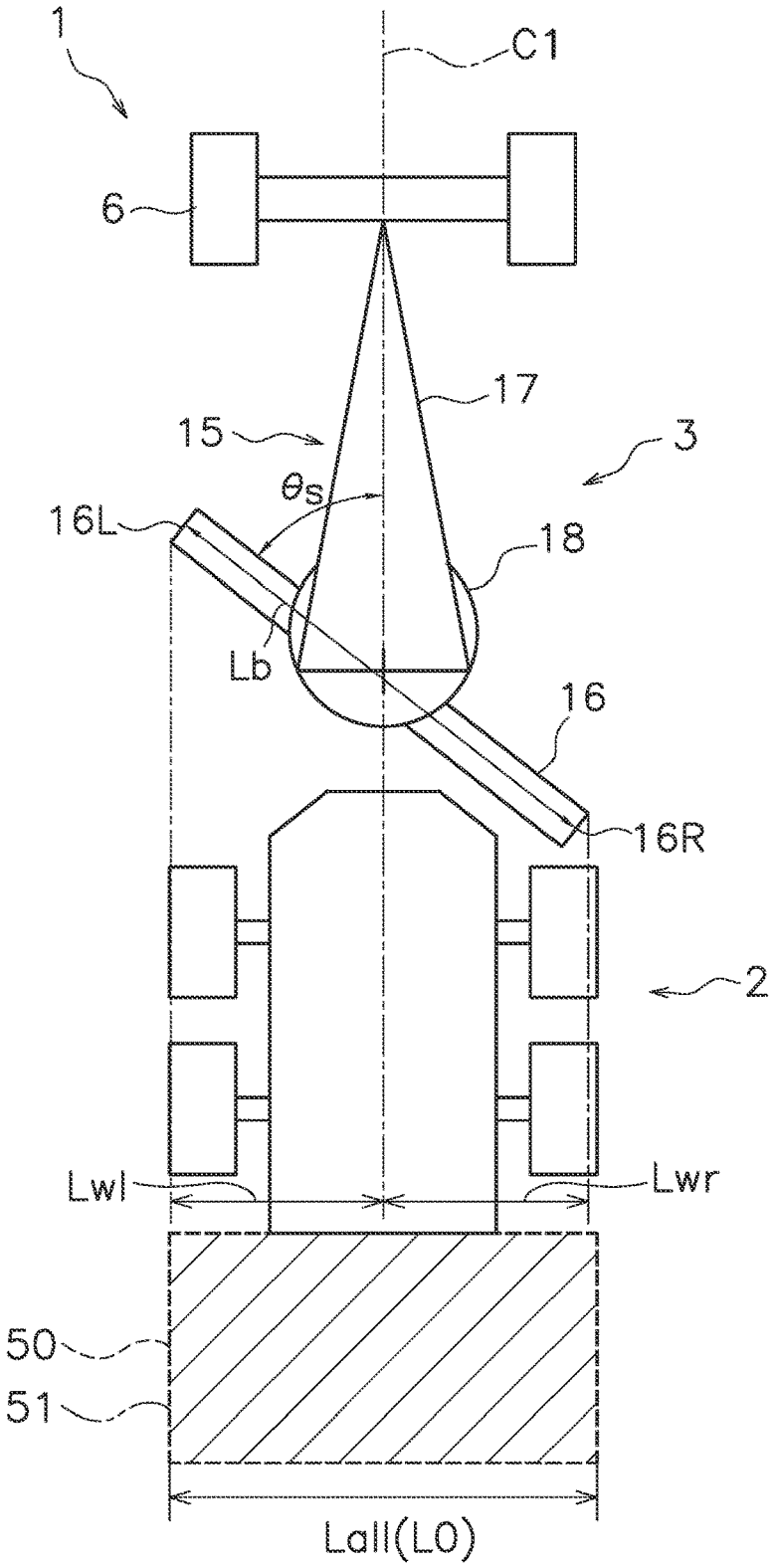
FIG. 12 is a schematic plan view of the work machine showing an example of the detection range.

In step S10, if the right end 16R of the blade 16 does not protrude from the vehicle width L0, the process proceeds to step S12. In step S12, the controller 36 sets the reference range 51 as the detection range 50, as shown in FIG. 12. That is, when both the left end 16L and the right end 16R of the blade 16 are located within the vehicle width L0, the controller 36 sets the reference range 51 as the detection range 50 without expanding the detection range 50 to the left or the right.

In the work machine 1 according to the present embodiment described above, the detection range 50 of objects around the work machine 1 is set according to the blade rotation angle θs, the blade shift amount Lbs, and the drawbar shift amount Lds. Thereby, it is possible to appropriately determine whether or not an object exists around the work machine 1.

Although one embodiment of the present invention has been described above, the present invention is not limited to the above embodiment, and various changes can be made without departing from the gist of the invention.

The work machine 1 is not limited to a motor grader, but may be another type of work machine. The configuration of the work machine 1 is not limited to that described above, and may be modified. For example, the configuration of the work implement 3 may be changed. A part of the control system of the work machine I may be located outside of the work machine 1. For example, the operating device 35 and the output device 45 may be disposed outside the work machine 1.

The controller 36 may be configured by a plurality of controllers. The above-described processing may be executed in a distributed manner across the plurality of controllers. Some of the plurality of controllers may be placed outside the work machine 1.

The processing performed when an object is detected within the detection range 50 is not limited to that of the embodiment described above, and may be modified. For example, when an object is detected within the detection range 50, the controller 36 may perform processing such as stopping the work implement 3 and/or the vehicle body 2, or restricting the operation thereof.

The process for setting the detection range 50 is not limited to that of the above embodiment, and may be modified. For example, in consideration of detection errors, the controller 36 may add an arbitrary margin width to the width Lall of the detection range 50 described above.

Figure 13:
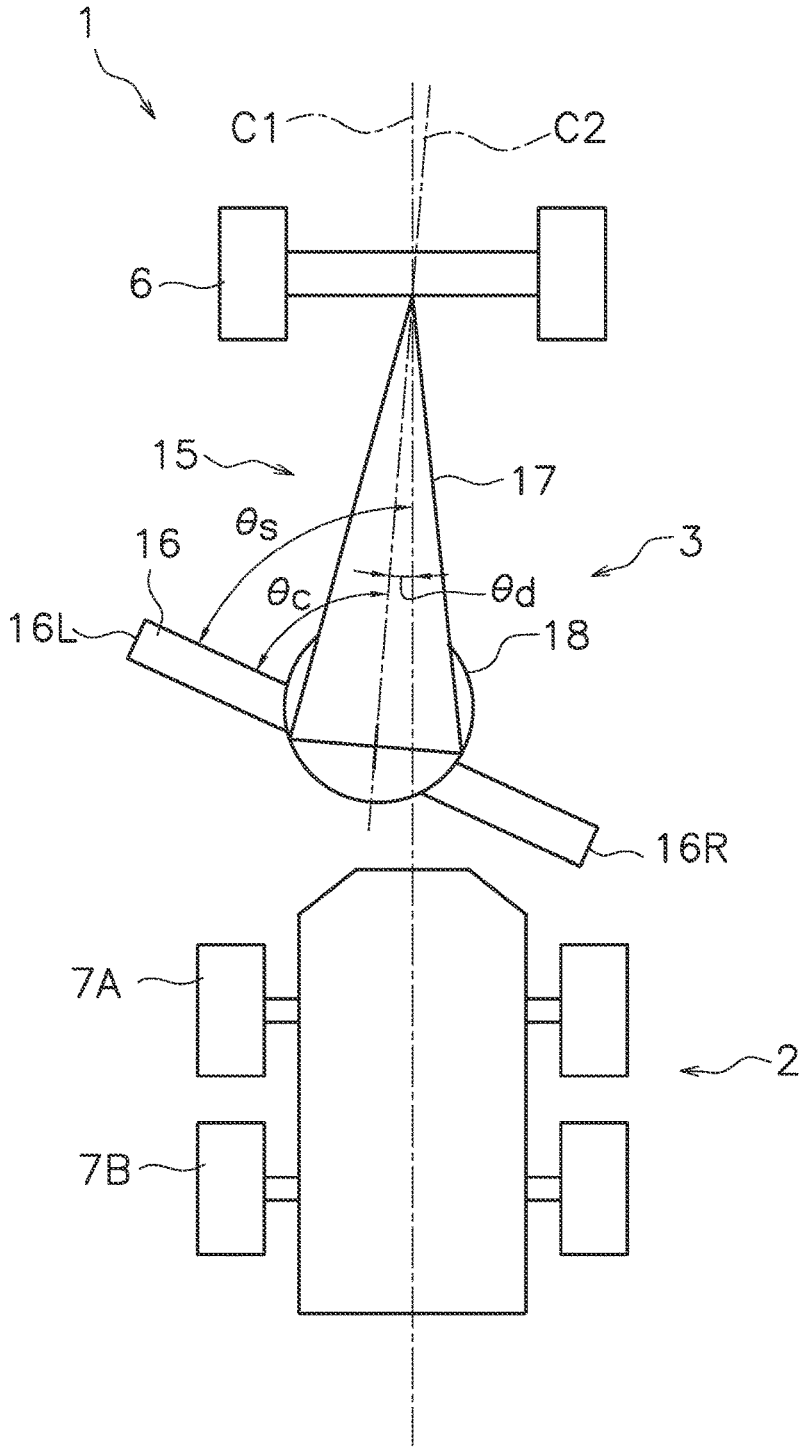
FIG. 13 is a diagram showing another example of a method for calculating a blade rotation angle.

As shown in FIG. 13, the controller 36 may calculate the blade rotation angle θs from the drawbar rotation angle θd and the circle rotation angle θc. The drawbar rotation angle θd is the angle of the center line C2 of the drawbar 17 with respect to the center line C1 of the vehicle body 2. The circle rotation angle θc is the angle of the blade 16 with respect to the center line C2 of the drawbar 17. In this case, the rotation angle sensor 41 may include a rotation angle sensor that detects the drawbar rotation angle θd and a rotation angle sensor that detects the circle rotation angle θc.

According to the present invention, it is possible to appropriately determine whether an object exists around a work machine.

The invention claimed is:

1. A work machine comprising:

a vehicle body;

a support member connected to the vehicle body;

a blade rotatably supported by the support member;

a rotation angle sensor configured to detect a rotation angle of the blade;

an object sensor configured to detect an object around the work machine and output a signal indicating a presence or absence of the object; and a controller configured to set a detection range around the work machine and determine the presence or absence of the object within the detection range based on the signal from the object sensor, the controller being configured to set the detection range according to the rotation angle of the blade.

2. The work machine according to claim 1, wherein the controller is configured to set a reference range for the detection range based on a width of the vehicle body, and expand the detection range from the reference range based on the rotation angle of the blade.

3. The work machine according to claim 2, wherein the controller is configured to detect a position of a left end and a position of a right end of the blade based on the rotation angle of the blade, expand the detection range leftward from the reference range when the left end of the blade protrudes from the vehicle body in a width direction, and expand the detection range rightward from the reference range when the right end of the blade protrudes from the vehicle body in the width direction.

4. The work machine according to claim 1, wherein the support member supports the blade in a slidable manner left and right, the work machine further comprises a blade shift sensor configured to detect a blade shift amount indicating an amount of a left and right movement of the blade, and the controller is configured to set the detection range according to the blade shift amount.

5. The work machine according to claim 1, wherein the support member includes a drawbar supported by the vehicle body so as to be swingable left and right, the work machine further comprises a drawbar shift sensor configured to detect a drawbar shift amount indicating an amount of a left and right movement of the drawbar, and the controller is configured to set the detection range according to the drawbar shift amount.

6. A method for controlling a work machine, the work machine including a vehicle body, a support member connected to the vehicle body, and a blade rotatably supported by the support member, the method comprising:

obtaining a rotation angle of the blade;

receiving a signal indicating a presence or absence of an object around the work machine;

setting a detection range around the work machine;

determining the presence or absence of the object within the detection range based on the signal; and setting the detection range according to the rotation angle of the blade.

7. The method according to claim 6, further comprising:

setting a reference range for the detection range based on a width of the vehicle body; and expanding the detection range from the reference range based on the rotation angle of the blade.

8. The method according to claim 7, further comprising:

detecting a position of a left end and a position of a right end of the blade based on the rotation angle of the blade;

expanding the detection range leftward from the reference range when the left end of the blade protrudes from the vehicle body in a width direction; and expanding the detection range from the reference range rightward when the right end of the blade protrudes from the vehicle body in the width direction.

9. The method according to claim 6, wherein the support member supports the blade in a slidable manner left and right, and the method further comprises:

obtaining a blade shift amount indicating an amount of a left and right movement of the blade; and setting the detection range according to the blade shift amount.

10. The method according to claim 6, wherein the support member includes a drawbar supported by the vehicle body so as to be swingable left and right, and the method further comprises:

obtaining a drawbar shift amount indicating an amount of a left and right movement of the drawbar; and setting the detection range according to the drawbar shift amount.

11. A system for controlling a work machine, the work machine including a vehicle body, a support member connected to the vehicle body, and a blade rotatably supported by the support member, the system comprising:

a rotation angle sensor configured to detect a rotation angle of the blade;

an object sensor configured to detect an object around the work machine and outputs a signal indicating a presence or absence of the object; and a controller configured to set a detection range around the work machine and determine the presence or absence of the object within the detection range based on the signal from the object sensor, the controller being configured to set the detection range according to the rotation angle of the blade.

12. The system according to claim 11, wherein the controller is configured to set a reference range for the detection range based on a width of the vehicle body, and expand the detection range from the reference range based on the rotation angle of the blade.

13. The system of claim 12, wherein the controller is configured to detect a position of a left end and a position of a right end of the blade based on the rotation angle of the blade, expand the detection range leftward from the reference range when the left end of the blade protrudes from the vehicle body in a width direction, and expand the detection range rightward from the reference range when the right end of the blade protrudes from the vehicle body in the width direction.

14. The system according to claim 11, wherein the support member supports the blade in a slidable manner left and right, the system further comprises a blade shift sensor configured to detect a blade shift amount indicating an amount of a left and right movement of the blade, and the controller is configured to set the detection range according to the blade shift amount.

15. The system according to claim 11, wherein the support member includes a drawbar supported by the vehicle body so as to be swingable left and right, the system further comprises a drawbar shift sensor configured to detect a drawbar shift amount indicating an amount of a left and right movement of the drawbar, and the controller is configured to set the detection range according to the drawbar shift amount.

* * * * *